US009296027B2

(12) United States Patent
Eckerstorfer et al.

(10) Patent No.: US 9,296,027 B2
(45) Date of Patent: Mar. 29, 2016

(54) METHOD AND PLANT FOR THE ENERGY-EFFICIENT PRODUCTION OF HOT STEEL STRIP

(75) Inventors: Gerald Eckerstorfer, Leonding (AT); Gerald Hohenbichler, Kronstorf (AT); Josef Watzinger, Reichenau (AT)

(73) Assignee: SIEMENS VAI METALS TECHNOLOGIES GMBH (AT)

( * ) Notice: Subject to any disclaimer, the term of this patent is extended or adjusted under 35 U.S.C. 154(b) by 0 days.

(21) Appl. No.: 13/877,876

(22) PCT Filed: Oct. 11, 2011

(86) PCT No.: PCT/EP2011/067670
§ 371 (c)(1), (2), (4) Date: Apr. 4, 2013

(87) PCT Pub. No.: WO2012/049135
PCT Pub. Date: Apr. 19, 2012

(65) Prior Publication Data
US 2013/0192790 A1 Aug. 1, 2013

(30) Foreign Application Priority Data
Oct. 12, 2010 (EP) ..... 10187232

(51) Int. Cl.
*B21B 1/46* (2006.01)
*B22D 11/041* (2006.01)
(Continued)

(52) U.S. Cl.
CPC ..... *B21B 1/463* (2013.01); *B22D 11/041* (2013.01); *B22D 11/043* (2013.01);
(Continued)

(58) Field of Classification Search
CPC ..... B21B 1/46; B21B 1/463; B22D 11/00; B22D 11/04; B22D 11/12; B22D 11/1213; B22D 11/122; B22D 11/1284; B22D 11/14; B22D 11/143
USPC ..... 164/441, 447, 484, 460, 476, 417, 477
See application file for complete search history.

(56) References Cited

U.S. PATENT DOCUMENTS 4,335,780 A * 6/1982 Burkhard ..... 164/441
4,872,946 A * 10/1989 Uesugi et al. ..... 205/139
(Continued)

FOREIGN PATENT DOCUMENTS

AU 624831 B2 6/1992 ..... B21B 1/46
CN 1214642 A 4/1999
(Continued)

OTHER PUBLICATIONS

Shore, R. et al., "Casting Technology and Machine Design Solutions for ESP Plants," Rolling & Processing Conference 2008, Paper No. 5.3, 10 pages, Sep. 16, 2008.
(Continued)

*Primary Examiner* — Kevin P Kerns
*Assistant Examiner* — Steven Ha
(74) *Attorney, Agent, or Firm* — Ostrolenk Faber LLP

(57) ABSTRACT

A method is disclosed for continuously or semi-continuously producing hot steel strip which, starting from a slab guided through a slab-guiding device, is rolled in a roughing train having at least four-stands, the method comprising: casting a slab in a die, the slab being reduced to a thickness of between 60 and 95 mm in a liquid core reduction process by the adjoining slab-guiding device, a slab support length measured between the meniscus, i.e., the bath level, of the die and an end of the slab-guiding device facing the roughing train being between 12 m and 15.5 m, and a casting speed ranging from 3.8 to 7 m/min. The disclosed combination of casting parameters may ensure that the crater tip of the slab extends to the vicinity of the end of the slab-guiding device independently of the respective maximum casting speeds which are dependent on the particular grade of material.

23 Claims, 5 Drawing Sheets

(51) Int. Cl.

| | |
|---|---|
| ***B22D 11/043*** | (2006.01) |
| ***B22D 11/12*** | (2006.01) |
| ***B22D 11/128*** | (2006.01) |
| ***B22D 11/14*** | (2006.01) |
| ***B22D 11/22*** | (2006.01) |
| ***B22D 11/124*** | (2006.01) |
| *B21B 45/00* | (2006.01) |

(52) U.S. Cl.

CPC ..... *B22D 11/1206* (2013.01); *B22D 11/1246* (2013.01); *B22D 11/1282* (2013.01); *B22D 11/142* (2013.01); *B22D 11/225* (2013.01); *B21B 45/004* (2013.01)

(56) References Cited

U.S. PATENT DOCUMENTS

| | | | | |
|---|---|---|---|---|
| 5,991,991 | A | 11/1999 | Pleschiutschnigg | 29/33 |
| 6,092,586 | A | 7/2000 | Schonbeck | 164/476 |
| 6,543,137 | B1 | 4/2003 | Noller et al. | 29/890.124 |
| 7,854,884 | B2 | 12/2010 | Schuster et al. | 266/114 |
| 7,909,085 | B2 | 3/2011 | Benedetti | 164/476 |
| 8,327,918 | B2 | 12/2012 | Seidel et al. | 164/454 |
| 2008/0035301 | A1 | 2/2008 | Arvedi | 164/460 |
| 2008/0276679 | A1 * | 11/2008 | Eckerstorfer et al. | 72/38 |
| 2010/0252149 | A1 | 10/2010 | Arvedi | 148/567 |
| 2013/0186588 | A1 | 7/2013 | Eckerstorfer et al. | 164/463 |
| 2013/0192790 | A1 | 8/2013 | Eckerstorfer et al. | 164/455 |

FOREIGN PATENT DOCUMENTS

| | | | | |
|---|---|---|---|---|
| CN | 1292847 | | 4/2001 | |
| CN | 1103647 | | 3/2003 | |
| CN | 1840252 | | 10/2006 | |
| CN | 101291750 | A | 10/2008 | |
| CN | 101336307 | A | 12/2008 | |
| DE | 19639302 | A1 | 3/1998 | B22D 11/04 |
| DE | 10025080 | A1 | 5/2001 | B21B 1/46 |
| DE | 102007058709 | A1 | 2/2009 | B21B 37/74 |
| EP | 0415897 | B1 | 2/1994 | H04B 1/10 |
| EP | 0889762 | B1 | 10/1999 | B21B 1/00 |
| EP | 0415987 | B2 | 11/1999 | B21B 1/46 |
| EP | 1059125 | | 6/2000 | |
| EP | 1 059 125 | A2 | 12/2000 | |
| EP | 1 870 172 | | 12/2007 | |
| EP | 1469954 | B2 | 3/2009 | B21B 1/26 |
| RU | 2166387 | C2 | 5/2001 | |
| RU | 2393034 | C2 | 6/2010 | |
| WO | WO 2007/045988 | | 4/2007 | |
| WO | 2007/086088 | A1 | 8/2007 | C21C 8/00 |
| WO | WO 2009/018957 | | 2/2009 | |
| WO | 2012/049107 | A1 | 4/2012 | B21B 1/463 |
| WO | 2012/049135 | A1 | 4/2012 | B21B 1/46 |

OTHER PUBLICATIONS

Siegl, J., "Arvedi ESP—Endless Strip Production, First Thin Slab Endless Casting and Rolling," 5th European Rolling Conference, London, 13 pages, Jun. 23, 2009.

Hochenbichler, Gerald et al., "Arvedi ESP—Technology and Plant Design," Millenium Steel 2010, URL: http://www.millennium-steel.com/articles/pdf/2010/pp82-88%20MS10.pdf, 7 pages, Mar. 1, 2010.

Arvedi, Giovanni, "Achievements of ISP Steelmaking Technology," Ironmaking and Steelmaking, vol. 37, No. 4, 6 pages, May 1, 2010.

Arvedi, G. et al., "Arvedi ESP First Thin Slab Endless Casting and Rolling Results," Ironmaking and Steelmaking, vol. 37, No. 4, 5 pages, May 1, 2010.

International Search Report, Application No. PCT/EP2011/067670, 5 pages, Dec. 16, 2011.

International Search Report, Application No. PCT/EP2011/067623, 5 pages, Dec. 27, 2011.

Chinese Office Action, dated Jul. 9, 2014, issued in corresponding Chinese Patent Application No. 201180049441.5. Including English Translation. Total 10 pages.

Russian Federation Decision on Grant, dated Oct. 30, 2015, issued in corresponding Russian Patent Application No. 2013121553/02(031675). Total 13 pages.

* cited by examiner

METHOD AND PLANT FOR THE ENERGY-EFFICIENT PRODUCTION OF HOT STEEL STRIP

CROSS-REFERENCE TO RELATED APPLICATIONS

This application is a U.S. National Stage Application of International Application No. PCT/EP2011/067670 filed Oct. 11, 2011, which designates the United States of America, and claims priority to EP Patent Application No. 10187232.3 filed Oct. 12, 2010. The contents of which are hereby incorporated by reference in their entirety.

TECHNICAL FIELD

The disclosure relates to a method as claimed in claim 1 for the continuous or semicontinuous production of hot steel strip which, starting from a strand that is guided through a strand-guiding device, is rolled in a roughing train to form an intermediate strip and is subsequently rolled in a finishing train to form a finished strip, and to a corresponding plant as claimed in claim 19 for implementing this method.

BACKGROUND

The terms continuous production or 'endless rolling' are used when a casting plant is connected to a rolling plant in such a way that the strand which has been cast in a die is guided directly—without separation from the strand part that is currently being cast and without intermediate storage—into a rolling plant where it is rolled to a desired final thickness. The start of the strand can therefore already be finish-rolled to form a steel strip having the final thickness while the casting plant continues to cast onto the same strand, such that the strand actually has no end. This is also referred to as direct-coupled operation or endless operation of the casting and rolling plant.

In the case of semicontinuous production or 'semicontinuous rolling', the cast strands are divided off after casting and the divided strands or slabs are supplied to the rolling plant without intermediate storage or cooling to ambient temperature.

The strand emerging from the casting plant first passes through a strand-guiding device that directly adjoins the die. The strand-guiding device, which is also called a 'strand-guiding corset', comprises a plurality (usually three to six) of guide segments, each guide segment comprising one or more (usually three to ten) pairs of guide elements that are preferably embodied as strand support rollers. The support rollers can rotate about an axis running orthogonally relative to the transport direction of the strand.

Individual guide elements can also be embodied as static e.g. runner-type components instead of strand support rollers.

Irrespective of the actual embodiment of the guide elements, these are disposed on both sides of the strand surfaces, such that the strand is guided by upper and lower series of guide elements and is conveyed to a roughing train.

To be precise, the strand is not supported solely by the strand-guiding device, but is also already supported by a lower exit region of the die, which can therefore also be considered part of the strand-guiding device.

The strand solidification starts at the upper end of the (open-ended) die, at the bath level or so-called 'meniscus', said die being typically 1 m long (0.3-1.5 m).

The strand emerges vertically downwards from the die and is deflected into the horizontal. The strand-guiding device therefore has a course that is essentially curved through an angular range of 90°.

The strand emerging from the strand-guiding device is reduced in thickness by the roughing train (HRM: high-reduction mill), and the resulting intermediate strip is heated by means of a heating arrangement and finish-rolled in a finishing train. Hot-rolling is performed in the finishing train, i.e. during rolling the rolled stock has a temperature which is higher that its recrystallization temperature. In the case of steel, this is the range above approximately 750° C., and hot rolling normally takes place at temperatures up to 1200° C.

When hot-rolling steel, the metal is normally in an austenitic state, in which the iron atoms are so disposed as to be cubic face centered. Rolling in an austenitic state is said to take place when both the starting temperature and the finishing temperature lie in the austenitic range of the steel concerned. The austenitic range of a steel is dependent on the steel composition, but is normally higher than 800° C.

Important parameters during the production process of hot steel strip from a combined casting and rolling plant are the casting speed at which the strand leaves the die (and passes through the strand-guiding device) and the mass throughput or volume flow, which is specified as the product of the casting speed and the thickness of the strand and is usually denoted by the unit [mm*m/min].

The steel strips thus produced undergo postprocessing for inter alia motor vehicles, household appliances and the building trade.

The continuous and semicontinuous manufacture of hot steel strips is known in the prior art. As a result of the casting plant and rolling plant being coupled together, the management of all plant parameters represents a considerable challenge in terms of process engineering. Modifications during the casting and rolling process, particularly as a result of changing the casting speed in combination with the strand thickness and changing a material-specific solidification coefficient that can be controlled by means of cooling, have a significant effect on the manufacturing quality and energy efficiency of the plant.

Methods and/or plants of the type in question are disclosed in EP 0 415 987 B1, EP 1 469 954 B1, DE 10 2007 058 709 A1 and WO 2007/086088 A1, for example.

Significant progress in the field of hot-rolling technology has been made by Acciaieria Arvedi S.p.A. in particular, which has developed a thin strand endless method that is based on ISP technology (In-line Strip Production) and goes by the name of Arvedi ESP (Endless Strip Production).

This technology allows a steel strip having a thickness of less than 0.8 mm to be manufactured without winding problems, wherein consistent and repeatable mechanical properties can be guaranteed over the entire width and length of the steel strip.

Using this ESP method, the casting and rolling operations are linked in a particularly advantageous manner, such that subsequent cold rolling is no longer required for many grades of hot steel strip. For grades of hot steel strip which still require subsequent cold rolling, the number of mill stands can be reduced in comparison with conventional rolling mills.

An ESP plant made by Arvedi for the production of hot steel strip, as published in e.g. the Rolling & Processing Conference '08 (September) and installed at Cremona (Italy), comprises a roughing train of three roughing stands adjoining a continuous casting plant, two strip separating devices, an induction furnace for the intermediate heating of the rough-rolled intermediate strip, followed by a finishing train of five finishing stands. The finished strip emerging from the roughing train is cooled in a cooling section and wound onto strip rolls weighing up to 32 tonnes by means of three underfloor coilers. A separating device in the form of a high-speed shearing machine is arranged in front of the underfloor coilers. Depending on the steel type and the thickness of rolled steel strip, the production capacity of this single-strand production line is approximately 2 million tonnes per year. This plant is also described in the following publications: Hohenbichler et al.: 'Arvedi ESP—technology and plant design', Millenium Steel 2010, 1 Mar. 2010, pages 82-88, London, and Siegl et al.: 'Arvedi ESP—First Tin Slab Endless Casting and Rolling Results', 5th European Rolling Conference, London, 23 Jun. 2009.

Such a plant allows hot strips having a final thickness of between 0.8 mm and 4 mm to be manufactured in continuous operation. For final strip thicknesses of between 4 mm and 12 mm, steel strip coils can be produced in semicontinuous operation, though according to calculations a width-specific minimum throughput of approximately 450 mm*m/min is required for low-carbon steels in continuous operation, in order to allow use of all five finishing stands in the finishing train.

Below this minimum throughput, only four finishing stands can be used, it being barely possible to achieve a volume flow of 400 mm*m/min for steel grades that must be cast more slowly due to specific requirements in terms of material properties. If faster cooling of the hot steel strip (intermediate strip) is required due to process engineering considerations, use of four finishing stands is questionable and use of only three finishing stands is indicated, even in the case of volume flows in the range of 400-450 mm*m/min.

In particular, an excessive strand support length of 17 m is disadvantageous, said length being the distance (more precisely known as the 'metallurgic length') between the discharge region of the die (specifically between the bath level or 'meniscus' of the liquid steel) and that end of the strand-guiding device facing the roughing train.

As described in the introduction, the strand-guiding device forms a partly curved receiving slot between the guide elements or strand support rollers for receiving the fresh cast strand (which still has a liquid core).

The end of the strand-guiding device is therefore understood in this context to mean the active guiding surface or surface line, which provides contact with the strand, of the last guide element (or last support roller in the upper series of guide elements) facing the roughing train.

A strand support length of 17 m results in complete solidification of the cross-sectional core of the strand before the strand emerges, and indeed several meters already before the end of the strand-guiding device. The technical processing advantage of a hot steel strip core, as per the ISP method, is therefore lost or not sufficiently utilized. The rolling of a completely solidified or cooler cast strand requires considerably greater energy expenditure than the rolling of a cast strand having a very hot cross-sectional core.

As the distance from the meniscus increases, the strand that is guided in the strand-guiding device or the steel strip in its initial form cools progressively. The inner region of the strand, which is still liquid or has a doughy/molten consistency, is subsequently referred to as a molten core. A 'molten core tip' of the molten core, being some distance from die, is defined as that central cross-sectional region of the strand in which the temperature only just corresponds essentially to the steel solidus temperature and then falls below this. The temperature of the molten core tip therefore corresponds to the solidus temperature of the respective steel type (typically between 1300° C. and 1535° C.).

For volume flows of less than 380-400 mm*m/min, the ISP or ESP method was previously only used for discontinuous production ('batch mode').

In the case of strand thicknesses of 45-65 mm, CSP (Compact Strip Production) methods described in the prior art likewise operate with volume flows below approximately 400 mm*m/min using a roller hearth furnace having a length of 250 m or more, wherein only discontinuous production ('batch mode') or semicontinuous production takes place. In the latter case, 3-6 separated (no longer connected to the casting plant or die) strands or slabs are endlessly rolled.

EP 0 889 762 B1 proposes a volume flow 0.487 $mm^2$/min (converted to the customary unit cited in the introduction: 487 mm*m/min) for the endless casting and rolling of hot strip. For many steel types, however, casting with such a high volume flow and a relatively modest strand thickness proves to be too fast to allow a satisfactory manufacturing quality to be guaranteed.

SUMMARY

One embodiment provides a method for the continuous or semicontinuous production of hot steel strip, comprising: casting a strand having a slab thickness of between 95 and 110 mm, guiding the strand through a strand-guiding device, rolling the strand in a roughing train to form an intermediate strip, and further rolling the strand in a finishing train to form a finished strip, wherein the strand-guiding device performs a liquid core reduction (LCR) process to reduce the strand, while the strand has a liquid cross-sectional core, to a strand thickness of between 60 mm and 95 mm, wherein a strand support length measured between a meniscus and an end of the strand-guiding device facing the roughing train is between 12 m and 15.5 m, and wherein a casting speed lies in a range of 3.8-7 m/min.

In a further embodiment, rough-rolling of the strand in the roughing train to form an intermediate strip takes place in at least four reduction stages using at least four roughing stands.

In a further embodiment, the reduction stages which take place in the roughing train take place within at most 80 seconds.

In a further embodiment, the first reduction stage in the roughing train takes place within at most 5.7 minutes from the start of solidification of the liquid strand in the die.

In a further embodiment, only cooling of the strand that is caused by ambient temperature is permitted between the end of the strand-guiding device and an intake region of the roughing train.

In a further embodiment, the thickness of the strand is reduced by 35-60% per reduction stage in the roughing train.

In a further embodiment, a temperature loss rate of the intermediate strip emerging from the roughing train is less than a maximum of 3 K/m.

In a further embodiment, the intermediate strip which emerges from the roughing train is heated by means of an inductive heating arrangement using a cross-field heating method, starting from a temperature above 725° C., to a temperature of at least 1100° C.

In a further embodiment, the heating of the intermediate strip takes place within a time span of 4 to 30 seconds.

In a further embodiment, if exactly four reduction stages are performed in the roughing train, the time duration between the first reduction stage and the intake into the heating arrangement is no longer than 110 seconds for an intermediate strip thicknesses of 5-10 mm.

In a further embodiment, finish-rolling of the heated intermediate strip in the finishing train takes place in four or five reduction stages using four or five finishing stands to form a finished strip having a thickness of less than 1.5 mm.

In a further embodiment, the reduction stages performed within the finishing train take place within a maximal time span of 12 seconds.

In a further embodiment, guide elements of the strand-guiding device, which are designed to provide contact with the strand, can be adjusted relative to a longitudinal axis of the strand for the purpose of LCR thickness reduction of the strand, wherein adjustment of the guide elements is performed as a function of at least one of the material of the strand and the casting speed.

In a further embodiment, the strand thickness can be set in a quasi static manner after the start of a casting sequence.

In a further embodiment, the strand thickness can be varied during the casting process or during the passage of the strand through the strand-guiding device.

In a further embodiment, for strand steels which are to be hard cooled by means of a spray arrangement in the region of the strand-guiding device during steady-state continuous operation of the plant, e.g., applying 3 to 4 liters of cooling agent per kg of strand steel, the correlation between a strand thickness measured in [mm] and the casting speed measured in [m/min] is governed by the formula $v_c=K/d^2$, wherein a speed factor contained in the formula lies in a corridor range of 30000 to 35200 (e.g., in a corridor range of 32500 to 35200) for a strand support length of 13 m, while the speed factor lies in a corridor range of 38000 to 44650 (e.g., in a corridor range of 41000 to 44650) for a strand support length of 16.5 m, and wherein interpolation between the corridor ranges listed above is possible for the purpose of determining casting speeds or strand thicknesses for plants having strand support lengths between the strand support lengths L=13 m and L=16.5 m.

In a further embodiment, for strand steels which are to be medium-hard cooled by means of a spray arrangement in the region of the strand-guiding device during steady-state continuous operation of the plant, e.g., applying 2 to 3.5 liters of cooling agent per kg of strand steel, the correlation between a strand thickness measured in [mm] and the casting speed measured in [m/min] is governed by the formula $v_c=K/d^2$, wherein a speed factor contained in the formula lies in a corridor range of 28700 to 33800 (e.g., in a corridor range of 31250 to 33800) for a strand support length of 13 m, while the speed factor lies in a corridor range of 36450 to 42950 (e.g., in a corridor range of 39700 to 42950) for a strand support length of 16.5 m, and wherein interpolation between the corridor ranges listed above is possible for the purpose of determining casting speeds or strand thicknesses for plants having strand support lengths between the strand support lengths L=13 m and L=16.5 m.

In a further embodiment, for strand steels which are to be soft cooled by means of a spray arrangement in the region of the strand-guiding device during steady-state continuous operation of the plant, e.g., applying less than 2.2 liters of cooling agent per kg of strand steel, the correlation between a strand thickness measured in [mm] and the casting speed measured in [m/min] is governed by the formula $v_c=K/d^2$, wherein a speed factor contained in the formula lies in a corridor range of 26350 to 32359 (e.g., in a corridor range of 29350 to 32359) for a strand support length of 13 m, while the speed factor lies in a corridor range of 34850 to 41200 (e.g., in a corridor range of 38000 to 41200) for a strand support length of 16.5 m, and wherein interpolation between the corridor ranges listed above is possible for the purpose of determining casting speeds or strand thicknesses for plants having strand support lengths between the strand support lengths L=13 m and L=16.5 m.

Another embodiment provides a plant for performing a method for continuous or semicontinuous production of hot steel strip as disclosed above, comprising a die, a strand-guiding device arranged behind this, a roughing train arranged behind this, an inductive heating arrangement arranged behind this, and a finishing train arranged behind this, wherein said strand-guiding device features a series of lower guide elements and a series of upper guide elements that is arranged in parallel or converges therewith, and wherein a receiving slot for receiving the strand that emerges from the die is formed between the two series of guide elements, said receiving slot being tapered at least sectionally by forming different distances between opposing guide elements in a transport direction of the strand such that the thickness of the strand can be reduced, wherein the internal receiving width of the receiving slot at its entrance region facing the die is between 95 mm and 110 mm, e.g., between 102 mm and 108 mm, and that the receiving slot at its end facing the roughing train has an internal receiving width corresponding to the thickness of the strand of between 60 mm and 95 mm, e.g., between 70 mm and 85 mm, wherein a strand support length measured between the meniscus i.e. the bath level of the die and that end of the receiving slot of the strand-guiding device facing the roughing train is between 12 m and 15.5 m, e.g., in a range of between 13 m and 15 m, e.g., between 14.2 m and 15 m, and wherein provision is made for a control device by means of which the casting speed of the strand can be maintained in a range of between 3.8-7 m/min.

In a further embodiment, the roughing train comprises four or five roughing stands.

In a further embodiment, no cooling device but a thermal cover is provided between the end of the receiving slot or strand-guiding device and an intake region of the roughing train.

In a further embodiment, by means of the roughing stands arranged in the roughing train, it is possible in each case to achieve a reduction in the thickness of the strand of 35-60% per roughing stand, thereby allowing the production of an intermediate strip having a thickness of between 3 mm and 15 mm.

In a further embodiment, the heating arrangement is designed as an inductive cross-field heating furnace by means of which the strand can be heated, starting from a temperature above 725° C., to a temperature of at least 1100° C.

In a further embodiment, the finishing train comprises four finishing stands or five finishing stands, by means of which an intermediate strip emerging from the roughing train can be reduced to form a finished strip having a thickness of less than 1.5 mm.

In a further embodiment, the finishing stands are disposed at distances of less than 7 m relative to each other in each case, said distances being measured between the working roll axes of the finishing stands.

In a further embodiment, for the purpose of reducing the thickness of the strand, specific guide elements are adjustable such that an internal receiving width of the receiving slot can be decreased or increased, wherein the strand thickness or the internal receiving width can be set as a function of the material of the strand and/or the casting speed.

In a further embodiment, the adjustable guide elements are disposed in a front half, facing the die, of the longitudinal extension of the strand-guiding device.

In a further embodiment, a working roll axis of the first roughing stand of the roughing train, being closest to the strand-guiding device, is disposed no more than 7 m beyond the end of the strand-guiding device.

In a further embodiment, an intake end of the heating arrangement facing the roughing train is disposed no more than 25 m beyond the working roll axis of the roughing stand closest to the heating arrangement.

BRIEF DESCRIPTION OF THE DRAWINGS

Exemplary embodiments will be explained in more detail below based on the schematic drawings, wherein.

DETAILED DESCRIPTION

Figure 1:
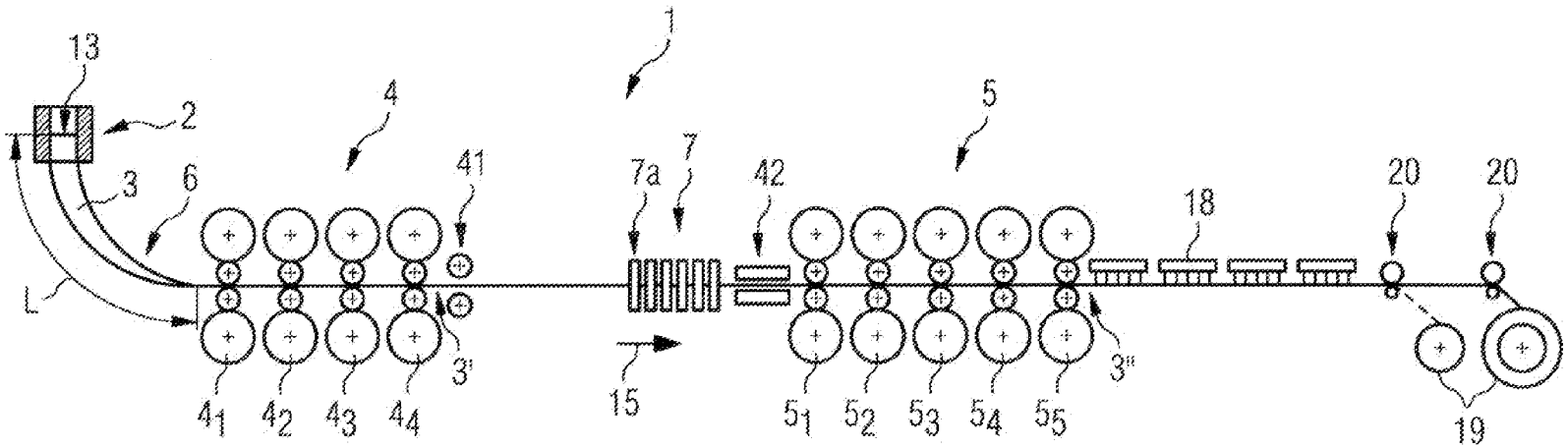
FIG. 1 is a schematic illustration of a plant according to an example embodiment for the continuous or semicontinuous production of hot steel strip in a side view.

In the light of increasing cost and manufacturing pressures, further optimization in the manufacture of hot steel strip is desirable.

It is desirable in particular to increase significantly the energy efficiency of plants of the type in question for producing hot steel strip, thereby allowing more economical manufacture.

In order to make optimal use of the casting heat during the manufacturing process for hot steel strip, it should be ensured that the molten core tip, i.e. the only just doughy/liquid cross-sectional core of the strand being transported in the strand-guiding device, is always as close as possible to the end of the strand-guiding device and hence as close as possible to the entrance of the roughing train.

One object is therefore to discover, for a multiplicity of steel grades, cooling parameters and strand thicknesses, those casting and rolling parameters by means of which the molten core tip of the strand can be preserved as far away from the die as possible, i.e. as close as possible to the end of the strand-guiding device.

In respect of this object, it must be taken into consideration that excessive casting speeds and/or volume flows passing through the strand-guiding device must also be avoided depending on a material-specific solidification factor and a strand thickness that is set in each case, as otherwise the molten core tip could overshoot the strand-guiding device and bulging or cracking of the strand could occur.

This object is achieved by a method having the features in claim 1 and a plant having the features in claim 19.

A method for the continuous or semicontinuous production of hot steel strip which, starting from a strand that is guided through a strand-guiding device, is rolled in a roughing train to form an intermediate strip and is subsequently rolled in a finishing train to form a finished strip, comprises the following method steps:

casting a strand in a die of a casting plant, wherein the strand emerging from the die and entering the strand-guiding device has a strand thickness of between 95 mm and 110 mm, preferably a strand thickness of between 102 mm and 108 mm, and wherein the strand is reduced using the liquid core reduction (LCR) process by means of the adjoining strand-guiding device, while the strand has a liquid cross-sectional core, to a strand thickness of between 60 mm and 95 mm, preferably to a strand thickness of between 70 mm and 85 mm, wherein a strand support length measured between the meniscus, i.e. the bath level of the casting plant, and an end of the strand-guiding device facing the roughing train is between 13 m and 15.5 m, preferably in a range of between 13 m and 15 m, preferably between 14.2 m and 15 m, and wherein a casting speed of the strand (which also corresponds essentially to the speed of the strand passing through the strand-guiding device) lies in a range of 3.8-7 m/min.

Using a combination of these casting parameters, it is ensured that the molten core tip of the strand always extends to the vicinity of the end of the strand-guiding device, irrespective of maximal casting speeds that depend on the grade of material in each case.

In this way, it is ensured that the strand has a sufficiently hot cross-sectional core during its thickness reduction, at least in the first mill train located after the strand-guiding device, in order that rolling can be performed with relatively modest energy expenditure while high manufacturing quality is guaranteed.

Consequently, the energy expenditure when rolling hot steel strip is significantly reduced and the efficiency is increased for plants of this type.

Specific process parameters have been determined by means of calculations and experimental arrangements and allow significant progress with regard to manufacturing quality and energy efficiency in the production of hot steel strip.

According to one embodiment, provision is made for the strand to be rough-rolled in the roughing train to form an intermediate strip in at least four reduction stages, i.e. using four roughing stands, and preferably in five reduction stages, i.e. using five roughing stands. Whereas rough-rolling of the strand usually takes place in three reduction stages in methods according to the prior art, the energy efficiency of the casting/rolling process can be increased further by performing four or five reduction stages. By performing four or five reduction stages in as rapid succession as possible, optimal use is made of the residual casting heat in the strand. Furthermore, by performing four or five reduction stages, almost irrespective of the starting thickness of the cast strand, a very narrow thickness range of the intermediate strip (between 3 mm and 15 mm, preferably between 4 mm and 10 mm) is achieved, such that a heating arrangement, e.g. an inductive cross-field heating furnace, arranged behind the roughing train can be configured exactly for a specific thickness range of the intermediate strip. It is therefore possible to avoid energy losses that are caused by overdimensioning the heating arrangement input.

According to a further embodiment, provision is made for the four or five reduction stages taking place in the roughing train to take place within at most 80 seconds, and preferably within at most 50 seconds.

According to a further embodiment, provision is made for the first reduction stage in the roughing train to take place within at most 5.7 minutes, preferably within at most 5.3 minutes from the start of solidification of the liquid strand in the casting plant. Ideally, the first reduction stage in the roughing train takes place within at most 4.8 minutes, even at casting speeds in the region of 4 m/min.

According to a further embodiment, only such strand cooling as is caused by the ambient conditions in the form of natural convection and radiation is permitted between the end of the strand-guiding device and an intake region of the roughing train, i.e. no artificial cooling of the strand by means of a cooling device takes place.

According to a further embodiment, provision is made for reducing the thickness of the strand in the roughing train by 35-60% and preferably by 40-55% per reduction stage. If exactly four mill stands are provided, this means that an intermediate strip having a thickness of approximately 3 mm to 15 mm, preferably a thickness of 4 mm to 10 mm emerges from the roughing train 4. By comparison, the intermediate strip is rolled to a thickness of between 10 mm and 20 mm in the case of an ESP plant according to the prior art as described in the introduction.

According to a further embodiment, provision is made for a temperature loss rate of the intermediate strip emerging from the roughing train to be less than a maximum of 3 K/m, preferably less than a maximum of 2.5 K/m. The realization of a temperature loss rate of <2 K/m is also conceivable.

According to a further embodiment, provision is made for the intermediate strip that emerges from the roughing train to be heated by means of an inductive heating arrangement, preferably using the cross-field heating method, starting from a temperature above 725° C. and preferably above 850° C., to a temperature of at least 1100° C. and preferably to a temperature above 1180° C.

According to a further embodiment, provision is made for the heating of the intermediate strip to take place within a time span of 4 to 30 seconds, preferably within a time span of 5 to 15 seconds.

According to a further embodiment, if exactly four reduction stages are performed in the roughing train, provision is made for the time duration between the first reduction stage and the intake into the heating arrangement to be no longer than 110 seconds and preferably no longer than 70 seconds for intermediate strip thicknesses of 5-10 mm.

Compliance with these parameters results in a very compact plant in which the distance of the heating arrangement from the casting plant or from the roughing train is kept very small, thereby providing an advantage in terms of thermal efficiency.

According to a further embodiment, provision is made for finish-rolling of the heated intermediate strip in the finishing train to take place in four reduction stages, i.e. using four finishing stands, or in five reduction stages, i.e. using five finishing stands, to form a finished strip having a thickness of <1.5 mm, preferably <1.2 mm. Rolling to final thicknesses of <1 mm is also possible using a method as disclosed herein.

According to a further embodiment, provision is made for the reduction stages performed by the five or four finishing stands within the finishing train to take place within a maximal time span of 12 seconds and preferably within a maximal time span of 8 seconds.

According to a further embodiment, guide elements of the strand-guiding device, being designed to provide contact with the strand, can be (transversely) adjusted relative to a longitudinal axis of the strand for the purpose reducing the strand thickness by means of liquid core reduction (LCR), said adjustment of the guide elements being performed as a function of the material of the strand and/or the casting speed, in order to reduce the strand thickness by up to 30 mm.

According to a further embodiment, provision is made here for the strand thickness to be set once in a quasi-static manner, i.e. shortly after the start of casting or casting onto a casting sequence and as soon as the hot front end region of the strand (also referred to as the 'strand head') has passed the guide elements that are provided for thickness reduction.

In one embodiment, however, provision can also be made for the strand thickness to be set dynamically, i.e. varied as desired during the casting process or during the passage of the strand through the strand-guiding device. If the dynamic setting only changes occasionally, it is preferably set by the operating team as a function of the steel grade and the current casting speed. The LCR thickness reduction is between 0 mm and 30 mm, preferably between 3 mm and 20 mm.

In one embodiment of the dynamic application of LCR, this function can also be performed by an automated arrangement, particularly if very frequent changes to thickness or speed are common or necessary.

The correlation of the setting of the strand thickness in relation to the casting speed is derived by means of speed factors that are proposed herein and whose selection depends on the strand support length and the grade of the strand steel.

Corridor ranges within which casting operation can be efficiently and beneficially performed are specified for the speed factor K in each case.

The cooling characteristics of respective steel grades have a significant effect on the position of the molten core tip within the strand. Rapidly solidifying steel grades allow operation of the plant at relatively high casting speeds $v_c$, while lower casting speeds $v_c$ should be selected for steel grades that solidify more slowly, in order to prevent bulging and cracking of the strand in the region of the molten core tip. The terms 'hard cooling' (rapid solidification), 'medium-hard cooling' and 'soft cooling' (slower solidification) are used in relation to the speed of the cooling of the strand.

For the purpose of cooling the strand, a cooling agent (preferably water) is applied to the strand in the region of the strand-guiding device (between the end of the die and that end of the strand-guiding device facing the roughing train). The application of the cooling agent to the strand is effected by means of a spray arrangement which can comprise any number of spray nozzles.

3 to 4 liters of cooling agent per kg of strand steel are used for hard cooling, while 2 to 3.5 liters of cooling agent per kg of strand steel are used for medium-hard cooling, and <2.2 liters of cooling agent per kg of strand steel are used for soft cooling. The specified cooling agent quantities for hard, medium-hard and soft cooling overlap, since the realization of hard, medium-hard or soft cooling in practice depends not only on the cooling agent quantity, but also on the structural embodiment of the spray arrangement, in particular on the type of nozzle structure, wherein either pure-water nozzles or air/water nozzles ('2-phase' nozzles) can be used. Further factors influencing the speed of strand cooling include the design of the guide elements or strand support rollers of the strand-guiding device (internal or circumferential cooling of the strand support rollers), the disposition of the support rollers, in particular the ratio of the support roller diameter to the distance of adjacent support rollers, the spray character of the nozzles, and the temperature of the cooling agent or water.

The selection of an actual speed factor K within the presently proposed corridor ranges depends in particular on the steel grade or the cooling characteristics of the strand. A speed factor K lying in the upper region of a proposed corridor range can be used for steel grades that are to be cooled rapidly, while a speed factor K lying in a central or lower region of a proposed corridor range is used for steel grades that are to be cooled more slowly.

According to a process-engineering optimization, for strand steels that are to be hard cooled by means of a spray arrangement in the region of the strand-guiding device during steady-state continuous operation of the plant, i.e. applying 3 to 4 liters of cooling agent per kg of strand steel, provision is therefore made for the correlation between a strand thickness d measured in [mm] and the casting speed $v_c$ measured in [m/min] to be governed by the formula $v_c=K/d^2$, wherein a speed factor K contained in the formula lies in a corridor range of 30000 to 35200 (preferably in a corridor range of 32500 to 35200) for a strand support length L=13 m, while the speed factor K lies in a corridor range of 38000 to 44650 (preferably in a corridor range of 41000 to 44650) for a strand support length L=16.5 m, and wherein interpolation between the corridor ranges listed above is possible for the purpose of determining (target) casting speeds $v_c$ or (target) strand thicknesses d for plants having strand support lengths between the strand support lengths L=13 m and L=16.5 m.

In this context, a steady-state continuous operation of the plant is understood to mean operating phases having a time duration of >10 minutes, during which the casting speed is essentially constant. This definition of the steady-state continuous plant operation merely serves to distinguish it from a casting phase during which the liquid steel first passes through the strand-guiding device and during which the casting speed is based on exceptional parameters, and from acceleration phases that may occur from time to time for increasing the throughput and/or from delay phases due to operational requirements (when waiting for the delivery of liquid steel or due to the strand quality, lack of cooling water, etc.).

For strand steels that are to be medium-hard cooled during steady-state continuous operation of the plant, i.e. applying 2 to 3.5 liters of cooling agent per kg of strand steel, the correlation between a strand thickness d measured in [mm] and the casting speed $v_c$ measured in [m/min] is governed by the formula $v_c=K/d^2$, wherein a speed factor (K) contained in the formula lies in a corridor range of 28700 to 33800 (preferably in a corridor range of 31250 to 33800) for a strand support length L=13 m, while the speed factor K lies in a corridor range of 36450 to 42950 (preferably in a corridor range of 39700 to 42950) for a strand support length L=16.5 m, and wherein interpolation between the corridor ranges listed above is possible for the purpose of determining (target) casting speeds $v_c$ or (target) strand thicknesses d for plants having strand support lengths L between the strand support lengths L=13 m and L=16.5 m.

For strand steels that are to be soft cooled during steady-state continuous operation of the plant, i.e. applying less than 2.5 liters (preferably 1.0 to 2.2 liters) of cooling agent per kg of strand steel, the correlation between a strand thickness d measured in [mm] and the casting speed $v_c$ measured in [m/min] is governed by the formula $v_c=K/d^2$, wherein a speed factor K contained in the formula lies in a corridor range of 26350 to 32359 (preferably in a corridor range of 29350 to 32359) for a strand support length L=13 m, while the speed factor K lies in a corridor range of 34850 to 41200 (preferably in a corridor range of 38000 to 41200) for a strand support length L=16.5 m, and wherein interpolation between the corridor ranges listed above is possible for the purpose of determining (target) casting speeds $v_c$ or (target) strand thicknesses d for plants having strand support lengths L between the strand support lengths L=13 m and L=16.5 m.

In addition to the strand support length, the detailed/precise selection of the speed factor is dependent on the carbon content of the cast steels, their solidification or transformation characteristics, and their properties in terms of strength and ductility.

An operating regime that complies with the speed factors K proposed herein allows optimal utilization of the casting heat contained in the strand for the subsequent rolling process, and allows optimization of the material throughput and hence productivity advantage (if the casting speed is reduced due to operational circumstances, the strand thickness can be increased and the material throughput can therefore be increased).

Other embodiments provides a plant for performing the disclosed method for continuous or semicontinuous production of hot steel strip, comprising a casting plant with a die, a strand-guiding device arranged behind this, a roughing train arranged behind this, an inductive heating arrangement arranged behind this, and a finishing train arranged behind this, wherein said strand-guiding device features a lower series of guide elements and an upper series of guide elements that is arranged in parallel with or converges with said lower series of guide elements, and a receiving slot for receiving the strand that emerges from the casting plant is formed between the two series of guide elements, said receiving slot being tapered at least sectionally by forming different distances between opposing guide elements in a transport direction of the strand, whereby the strand thickness can be reduced. According to one embodiment, provision is made for the internal receiving width of the receiving slot at its entrance region facing the die to be between 95 mm and 110 mm, preferably between 102 mm and 108 mm, for the receiving slot at its end facing the roughing train to have an internal receiving width (corresponding to the thickness of the strand) of between 60 mm and 95 mm, preferably between 70 mm and 85 mm, wherein a strand support length measured between the bath level of the casting plant and that end of the receiving slot of the strand-guiding device facing the roughing train is between 12 m and 15.5 m, preferably in a range of between 13 m and 15 m, preferably between 14.2 m and 15 m, and wherein provision is made for a control device by means of which the casting speed of the strand can be maintained in a range of between 3.8-7 m/min.

According to a further embodiment, provision is made for the roughing train to comprise four or five roughing stands.

According to a further embodiment, no cooling device is provided between the end of the receiving slot or strand-guiding device and an intake region of the roughing train, but provision is made for a thermal cover which at least sectionally surrounds a conveyor device that is provided for transporting the strand, and consequently delays any cooling of the strand.

According to a further embodiment, provision is made for achieving a reduction in the thickness of the strand by means of the roughing stands that are arranged in the roughing train, by 35-60% in each case and preferably by 40-55% per roughing stand, such that an intermediate strip having a thickness of 3 mm to 15 mm, preferably a strand thickness of 4 mm to 10 mm, can be produced.

According to a further embodiment, provision is made for the heating arrangement to be designed as an inductive cross-field heating furnace by means of which the strand can be heated, starting from a temperature above 725° C. and preferably above 850° C., to a temperature of at least 1100° C., preferably to a temperature above 1180° C.

According to a further embodiment, provision is made for the finishing train to comprise four or five finishing stands by means of which an intermediate strip emerging from the roughing train can be reduced to a finished strip having a thickness of <1.5 mm, preferably <1.2 mm.

According to a further embodiment, provision is made for the finishing stands to be disposed in each case at distances of <7 m relative to each other, preferably at distances of <5 m, said distances being measured between the working roll axes of the finishing stands.

According to a further embodiment, for the purpose of reducing the thickness of the strand, provision is made for specific guide elements to be (gap) adjustable such that an internal receiving width of the receiving slot can be decreased or increased, wherein the strand thickness or the internal receiving width can be set as a function of the material of the strand and/or the casting speed.

According to a further embodiment, provision is made for the adjustable guide elements to be disposed in a front half and preferably in a front quarter, facing the die, of the longitudinal extension of the strand-guiding device.

In order to ensure the hottest possible strand core of the strand during at least the first two reduction stages in the roughing train, one embodiment of the plant provides for a working roll axis of a first (i.e. closest to the strand-guiding device) roughing stand of the roughing train to be disposed no more than 7 m and preferably no more than 5 m beyond the end of the strand-guiding device.

According to a further embodiment, provision is made for an intake end of the heating arrangement facing the roughing train to be disposed no more than 25 m and preferably no more than 19 m beyond the working roll axis of the roughing stand closest to the heating arrangement.

FIG. 1 schematically shows an example plant 1 by means of which a method can be implemented for the continuous or semicontinuous production of hot steel strip.

A vertical casting plant is shown comprising a die 2 in which strands 3 are cast, these having a strand thickness d of between 95 mm and 110 mm, preferably a strand thickness d of between 102 mm and 108 mm, at the end of the die 2.

The die 2 is preceded by a ladle 39, which supplies a header 40 with liquid steel via a ceramic feed nozzle. The header 40 then supplies the die 2, to which a strand-guiding device 6 is adjoined.

Rough-rolling then takes place in a roughing train 4, which can include one (as in this case) or a plurality of stands and in which the strand 3 is rolled to an intermediate thickness. The transformation from a cast structure into a fine-grain rolled structure occurs during rough-rolling.

The plant 1 further comprises a range of components such as e.g. descaling units 41, 42 and separating units (not shown in FIG. 1), which essentially correspond to the prior art and are therefore not explained in greater detail here. The separating units are embodied e.g. in the form of a high-speed shearing machine and can be disposed at any desired position in the plant 1, in particular between the roughing train 4 and the finishing train 5 and/or in a region downstream of the finishing train 5.

A heating arrangement 7 for the intermediate strip 3' is disposed downstream of the roughing train 4. The heating arrangement 7 is embodied as an induction furnace in the present exemplary embodiment. Use is preferably made of a cross-field heating induction furnace, which makes the plant 1 particularly energy-efficient.

Alternatively, the heating arrangement 7 could also be embodied as a conventional e.g. flame-based furnace or as a combined furnace comprising both HC fuel-fired and inductive parts.

In the heating arrangement 7, the intermediate strip 3' is raised relatively uniformly over its cross section to a desired intake temperature for the intake into the finishing train 5, said intake temperature normally being between 1000° C. and 1200° C. depending on the steel type and the subsequent rolling operation in the finishing train 5.

After the heating in the heating arrangement 7 and after intermediate optional descaling, finish-rolling to a desired final thickness and final rolled temperature takes place in the multi-stand finishing train 5, followed by strip cooling in a cooling section 18, and finally winding onto coils by means of underfloor coilers 19. Just in front of the underfloor coilers 19, the finished strip 3" is squeezed between drive rollers 20, whereby the finished strip" is guided and strip tension is maintained.

Figure 2:
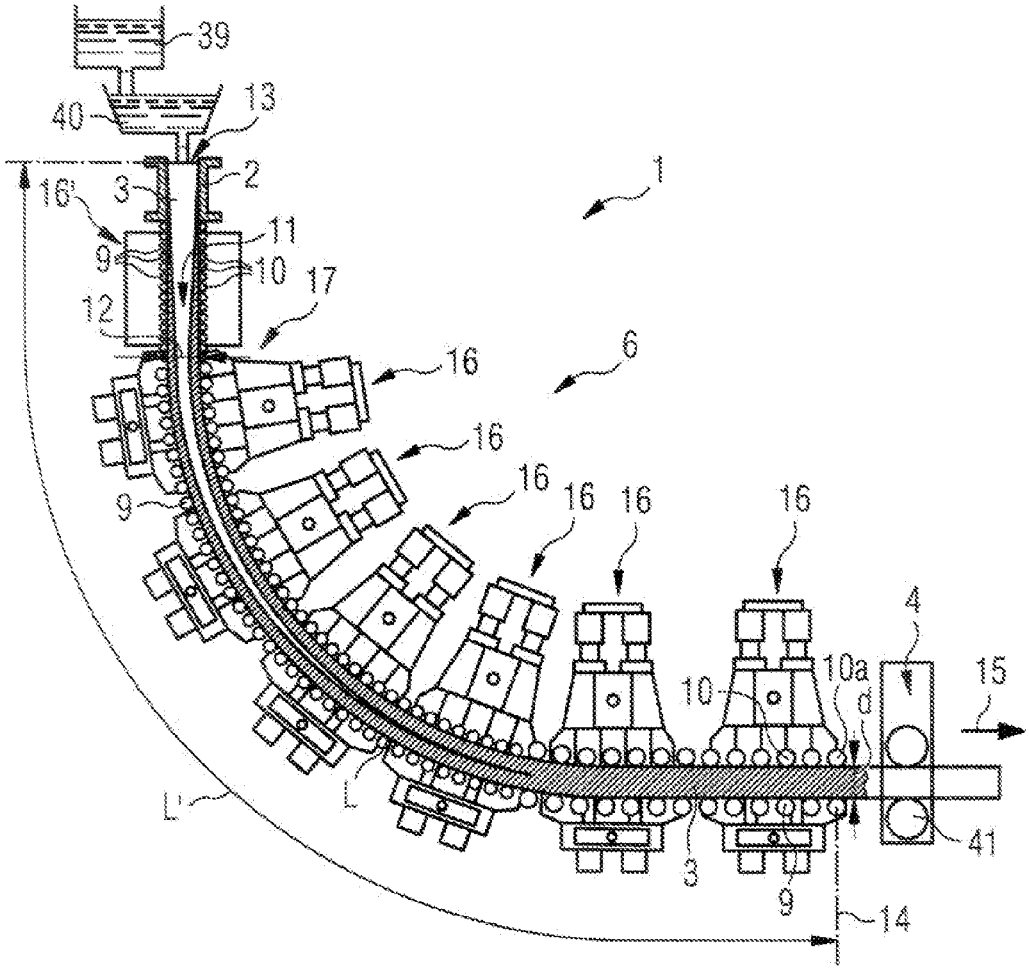
FIG. 2 is a detailed illustration of a strand-guiding device of the plant from FIG. 1 in a vertical sectional view.
Figure 3:
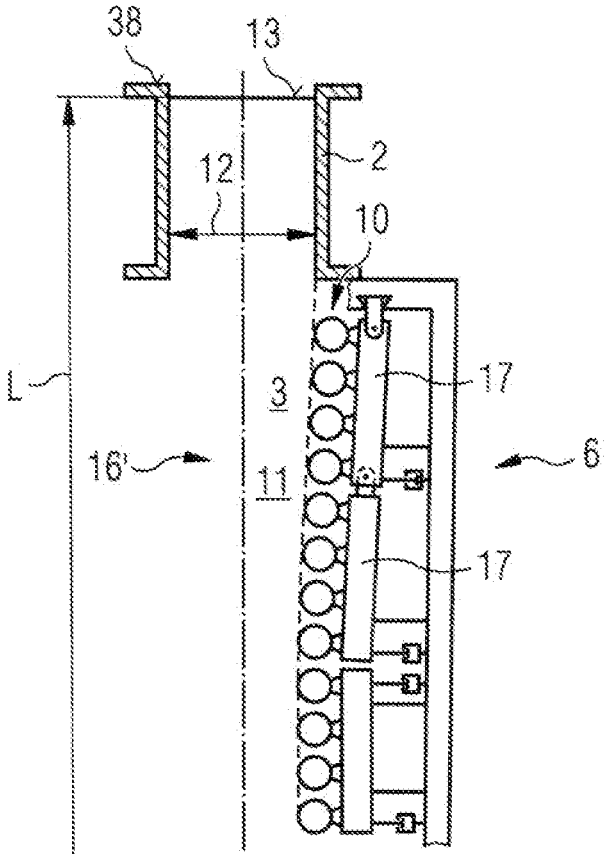
FIG. 3 shows a section of the strand-guiding device in a cutaway detailed view.

The following method steps are performed according to one embodiment:

A strand 3 is first cast by means of a casting plant 2 (one die of the casting plant is illustrated in the FIGS. 1-3). Using the liquid core reduction (LCR) process, the strand 3 having a liquid cross-section is reduced by means of the strand-guiding device 6 to a strand thickness d of between 60 mm and 95 mm, preferably to a strand thickness d of between 70 mm and 85 mm.

A strand support length L measured between the meniscus 13 (i.e. the bath level of the casting plant 2) and an end 14 of the strand-guiding device 6 facing the roughing train 4 is less than or equal to 16.5 m and greater than or equal to 10 m, specifically between 12 m and 15.5 m.

The meniscus 13 shown in detail in FIG. 3 is normally several centimeters below the top edge 38 of the die 2, which is usually made from copper.

The strand support length L is measured here between the meniscus 13 of the die (or the casting plant 2) and the axis of the last support roller of an upper series of guide elements 10 described in greater detail below, said last support roller facing a roughing train 4 (seen in a side view of the plant 1 from a viewing direction parallel with the axes of the rollers as per FIG. 1). In the context of a precise measurement, the strand support length L is measured at an outer surface of the strand 3 or strand-guiding device 6 (and a section of the interior of the die 2) relative to the center of the radius of curvature of the strand 3 or strand-guiding device 6. For ease of identification of the strand support length L or the outer surface of the strand 3, said outer surface being in contact with support rollers 10, a secondary dimensioning line L' is drawn in concentrically relative to the strand support length L FIG. 2.

As a further parameter, provision is made for a casting speed of the strand 3 measured during steady-state continuous operation of the plant (which also corresponds essentially to the speed of the strand 3 passing through the strand-guiding device 6, i.e. to the speed of the strand 3 at the end 14 of the strand-guiding device 6) to lie in a range of 3.8-7 m/min, preferably in a range of 4.2-6.6 m/min.

Using a combination of these casting parameters, it is ensured that the molten core tip of the strand 3 (as defined in the introduction) always extends so far as to be relatively close to the end of the strand-guiding device, irrespective of maximal casting speeds that depend on the grade of material in each case, such that the strand 3 can be both rough-rolled to a desired intermediate thickness and then finish-rolled with relatively modest energy expenditure while ensuring high manufacturing quality.

In the layout of the plant 1, the strand support length L is less than or equal to 15.5 m, and the strand support length L preferably lies in a range of between 13 m and 15 m. The strand support length L is at least 12 m and preferably at least 13 m.

Rough-rolling of the strand 3 in the roughing train 4 to form an intermediate strip 3' takes place in at least four reduction stages, i.e. using four roughing stands $\mathbf{4}_1$, $\mathbf{4}_2$, $\mathbf{4}_3$, $\mathbf{4}_4$, and preferably in five reduction stages, i.e. using five roughing stands $\mathbf{4}_1$, $\mathbf{4}_2$, $\mathbf{4}_3$, $\mathbf{4}_4$, $\mathbf{4}_5$.

The four or five reduction stages that take place in the roughing train 4 take place within at most 80 seconds, preferably within at most 50 seconds.

Provision is further made for the first reduction stage in the roughing train 4 to take place within at most 5.7 minutes, preferably within at most 5.3 minutes from the start of solidification of the liquid strand in the casting plant 2. Ideally, the first reduction stage in the roughing train 4 takes place within at most 4.8 minutes, even at a low continuous casting speed of 4 m/min.

Only such cooling of the strand 3 as is caused by the ambient temperature, this being very low relative to the strand surface, is permitted between the end 14 of the strand-guiding device 6 and an intake region of the roughing train 4, i.e. no artificial cooling of the strand 3 by means of a cooling device takes place. The surface of the strand 3 has an average temperature of >1050° C., preferably >1000° C. in this region. A preferably hinged cover is provided between the end 14 of the strand-guiding device 6 and the first roughing stand $\mathbf{4}_1$, in order to preserve the heat in the strand 3 as far as possible. The thermal cover at least sectionally surrounds a conveyor device which is provided for transporting the strand 3 and is usually embodied as a roller conveyor.

The thermal cover can surround the conveyor device from above and/or from below and/or from the side.

Provision is made for reducing the thickness d of the strand 3 in the roughing train 4 by 35-60% and preferably by 40-55% per reduction stage. If exactly four mill stands are provided, this means that an intermediate strip 3' having a thickness of 3 mm to 15 mm, preferably a thickness of 4 mm to 10 mm, emerges from the roughing train 4.

According to a further process-engineering variant, provision is made for a temperature loss rate of the intermediate strip 3' emerging from the roughing train 4 to be less than a maximum of 3 K/m, preferably less than a maximum of 2.5 K/m. The realization of a temperature loss rate of <2 K/m is also conceivable. Such temperature loss rates occur due to thermal radiation and/or convection of the intermediate strip, and can be controlled by means of corresponding selection of the thermal boundary conditions (covers, tunnel, cold air, air humidity, etc.) and transport speed and/or mass flow.

According to a further embodiment, provision is made for the intermediate strip 3' that emerges from the roughing train 4 to be heated by means of an inductive heating arrangement 7, preferably using the cross-field heating method, starting from a temperature above 725° C., preferably above 850° C. and most preferably above 900° C., to a temperature of at least 1100° C. and preferably to a temperature above 1180° C.

The heating of the intermediate strip 3' takes place within a time span of 4 to 30 seconds, preferably within a time span of 5 to 15 seconds.

If exactly four reduction stages are used in the roughing train 4, provision is made for a strand 3 which has a thickness of 80 mm when it emerges from the strand-guiding device 6, and which is reduced in the roughing train 4 to an intermediate strip 3' having a thickness of 5 mm, to be introduced into the inductive heating arrangement 7 at most 260 seconds and preferably at most 245 seconds after emerging from the die 2, and for a strand 3 which has a thickness of 95 mm when it emerges from the strand-guiding device 6, and which is reduced in the roughing train 4 to an intermediate strip 3' having a thickness of 5.5 mm, to be introduced into the inductive heating arrangement 7 at most 390 seconds and preferably at most 335 seconds after emerging from the die 2.

Finish-rolling of the heated intermediate strip 3' in the finishing train 5 preferably takes place in four reduction stages, i.e. using four finishing stands $\mathbf{5}_1$, $\mathbf{5}_2$, $\mathbf{5}_3$, $\mathbf{5}_4$, or in five reduction stages, i.e. using five finishing stands $\mathbf{5}_1$, $\mathbf{5}_2$, $\mathbf{5}_3$, $\mathbf{5}_4$, $\mathbf{5}_5$, to form a finished strip 3" having a final thickness of <1.5 mm, preferably <1.2 mm. Rolling to final thicknesses of <1 mm is also possible by means of a method as disclosed herein.

The finishing stands $\mathbf{5}_1$, $\mathbf{5}_2$, $\mathbf{5}_3$, $\mathbf{5}_4$, $\mathbf{5}_5$ are disposed at distances of <7 m and preferably at distances of <5 m relative to each other in each case (measured between the working roll axes of the finishing stands $\mathbf{5}_1$, $\mathbf{5}_2$, $\mathbf{5}_3$, $\mathbf{5}_4$, $\mathbf{5}_5$). According to one embodiment, the reduction stages within the finishing train 5 take place within a time span of at most 12 seconds, preferably within a time span of at most 8 seconds.

In the present exemplary embodiment, the finished strip 3" is subsequently cooled to a coiler temperature of between 500° C. and 750° C., preferably between 550° C. and 650° C., and wound onto a coil. Finally, the finished strip 3' or intermediate strip 3' or strand 3 is severed transversely relative to its transport direction 15 and the finished strip 3' now disconnected from the mill train is finish-coiled. As an alternative to coiling, the finished strip 3" can also be redirected and stacked.

As shown in FIG. 2, the strand-guiding device 6 comprises a plurality of guide segments 16 as per FIG. 3, these being designed to allow the passage of the strand 3 and comprising in each case a lower series of guide elements 9 (not shown in FIG. 3) and an upper series of guide elements 10 which is arranged in parallel with or converges with said lower series of guide elements 9.

Each guide element of the lower series of guide elements 9 is assigned to an opposing guide element of the upper series of guide elements 10. The guide elements are therefore arranged in pairs on both sides of the surfaces of the strand 3.

A receiving slot 11 for receiving the strand 3 that emerges from the die 2 is formed between the two series of guide elements 9, 10, said receiving slot 11 being tapered at least sectionally by means of forming different distances between opposing guide elements 9, 10 in a transport direction of the strand 3, thereby allowing the strand 3 to be reduced in thickness. The guide elements 9, 10 are embodied as support rollers that are so mounted as to allow rotation.

The upper and lower guide elements or series of support rollers 9, 10 can in each case be divided in turn into (sub-) series of specific support rollers having different diameters and/or distances between axes.

The guide elements of the upper series of guide elements 10 can be selectively adjusted in respect of depth and moved closer to the guide elements of the lower series of guide elements 9. Adjustment of the guide elements of the upper series of guide elements 10, thereby changing the internal cross section 12 of the receiving slot of the strand-guiding device 6, can be effected by means of a hydraulic drive, for example. An internal receiving width 12 of the receiving slot 11 of the strand-guiding device 6, being measured between opposing upper and lower guide elements, corresponds to the desired strand thickness and could be reduced from 100 mm to a range of between 70 mm and 90 mm, for example.

Since a strand 3 that is guided in a narrower receiving slot 11 solidifies and cools more quickly, the casting speed and correspondingly the volume flow passing through the mill trains 4, 5 must be increased if it is intended that the molten core tip of the strand should nonetheless extend as closely as possible to the end of the strand-guiding device 6.

For the purpose of reducing the thickness of the strand 3, e.g. three to eight guide element pairs of a first guide segment 16', which faces the die 2 but is not necessarily adjoined to the die 2, can be adjusted. Alternatively, a larger number of sequential guide segments 16 which directly or indirectly adjoin the die can also be used for the purpose of LCR thickness reduction.

The strand thickness d or the internal receiving width 12 is set as a function of the material of the strand 3 and/or as a function of the casting speed. The adjustment of the respective guide elements 9, 10 is effected in a direction that is essentially orthogonal relative to the transport direction of the strand, wherein both the upper guide elements 10 and the lower guide elements 9 can be adjustable. As shown in FIG. 3, upper guide elements 10 are linked to corresponding support elements 17 which are preferably hydraulically adjustable. The (hydraulically) adjustable LCR guide elements 9, 10 are preferably disposed in a front half and preferably in a front quarter, facing the die 2, of the longitudinal extension of the strand-guiding device 6.

The setting of the strand thickness d or of the internal receiving thickness 12 can be quasi static, i.e. it occurs once shortly after the start of casting and as soon as a head region of the cast strand 3 facing the roughing train 4 reaches the end of the strand-guiding device 6 or has passed the LCR guide elements, or dynamic, i.e. it occurs during the casting process and/or during the continuous quasi steady-state passage of the strand 3 through the strand-guiding device 6. In the case of dynamic setting, the strand thickness d is changed as often as required during the passage of a strand 3 through the strand-guiding device 6, applying a correlation that is explained below with reference to FIG. 7 as a guideline.

Figure 4:
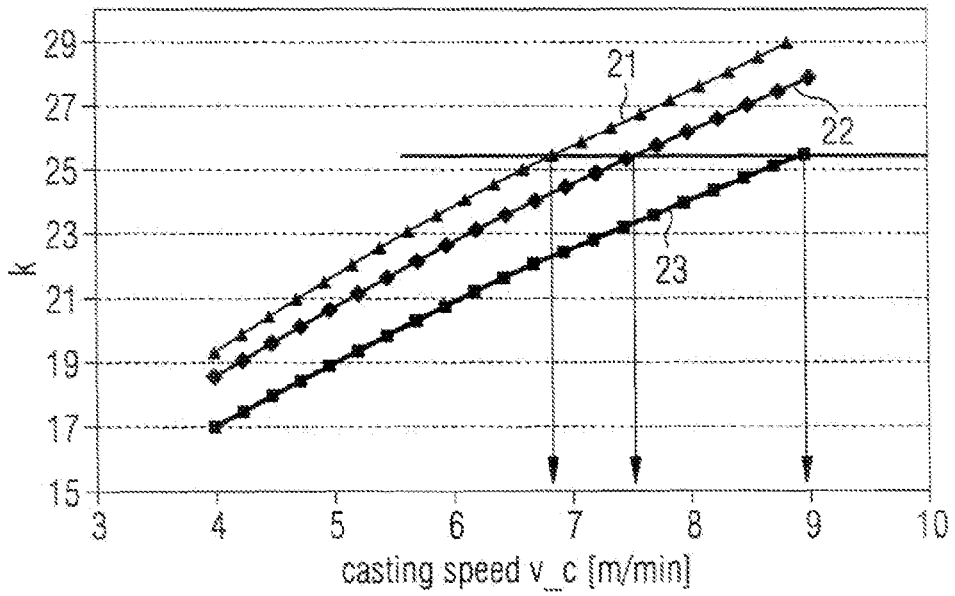
FIG. 4 shows a process diagram of manufacturing methods according to the prior art.

FIG. 4 shows a diagram for plants according to the prior art, from which maximal permitted casting speeds can be seen for strands of different thicknesses.

The casting speed denoted by the unit [m/min] is plotted on the X-axis of this diagram, while a material-specific solidification factor k denoted by the unit [mm/√min] is plotted on the Y-axis. The solidification factor k lies between 24 mm/√min and 27 mm/√min, preferably between 25 mm/√min and 26 mm/√min. In the example according to FIG. 4, a solidification factor k of 25.5 mm/√min is drawn as a horizontal line which intersects three lines 21, 22, 23.

Line 21 designates a strand having a strand thickness of 80 mm, line 22 a strand having a strand thickness of 55 mm, and line 23 a strand having a strand thickness of 70 mm. It should be noted that these linear profiles only apply in each case to strands which are cast in a strand support device 6 having a specific strand support length L. In this case, the lines 21 and 23 designate strands which are cast in a strand support device 6 having a strand support length of L=17 m, while the line 22 designates a strand that is cast in a strand support device 6 having a strand support length of L=9 m. An intersection of the horizontal line corresponding to the solidification factor k=25.5 mm/√min with the line 21 further shows that a maximal casting speed of 6.8 m/min can be selected for strand thicknesses of 80 mm. The casting speed that is actually used may be lower, in order to ensure a flawless process in terms of manufacturing engineering, but must not be higher than this value as otherwise the molten core tip of the strand would overshoot the end 14 of the strand support device 6 or of the receiving slot 11 in a transport direction 15 and cracking of the strand might occur.

A maximal casting speed of 7.6 m/min is permitted for strand thicknesses of 55 mm (line 22) and a maximal casting speed of approximately 8.9 m/min is permitted for strand thicknesses of 70 mm (line 23). Flawless production quality cannot be guaranteed when using such high casting speeds for relatively modest strand thicknesses.

Figure 5:
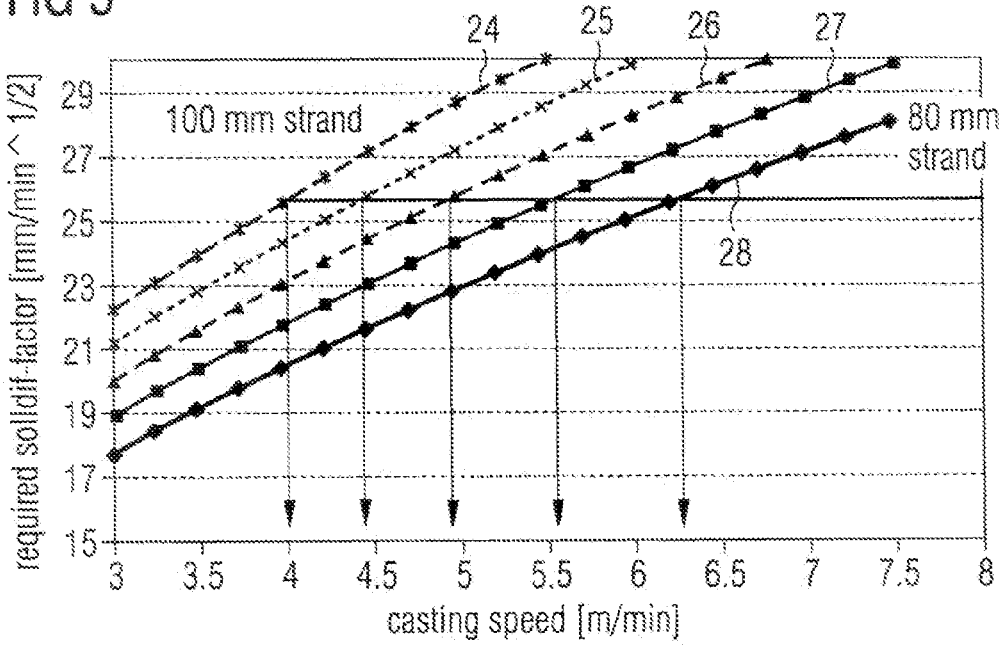
FIG. 5 shows a process diagram of a manufacturing method according to an example embodiment (solidification factor as a function of the casting speed)

FIG. 5 shows a diagram which has X-axis and Y-axis scales corresponding to those in FIG. 4 but relates to strands that are cast in a strand support device 6 having a strand support length L of 15.25 m, said length being proposed herein and being particularly advantageous in terms of metallurgy.

The casting characteristics described below are purely exemplary and do not limit the scope of the invention. There is essentially no fixed speed value for each strand thickness, but a corresponding speed range in each case, within which the casting process can be beneficially performed. Likewise, the strand support length L is not reduced to a specific value such as e.g. 15.25 m as per FIG. 4, but calculations and considerations of the inventors have shown that strand support lengths L in the range of between 12 m and 16.5 m already offer significant advantages relative to known plants.

In a similar manner to the intersection shown in FIG. 4, a solidification factor k=25.5 mm/√min for a strand thickness of 100 mm as indicated by line 24 results in a maximal casting speed of 4 m/min read from the X-axis according to FIG. 5. A maximal casting speed of 4.4 m/min is permitted for a strand thickness of 95 mm (line 25), a maximal casting speed of approximately 4.9 m/min for a strand thickness of 90 mm (line 26), a maximal casting speed of 5.6 m/min for a strand thickness of 85 mm (line 27), and a maximal casting speed of 6.25 m/min for a strand thickness of 80 mm (line 28).

Figure 6:
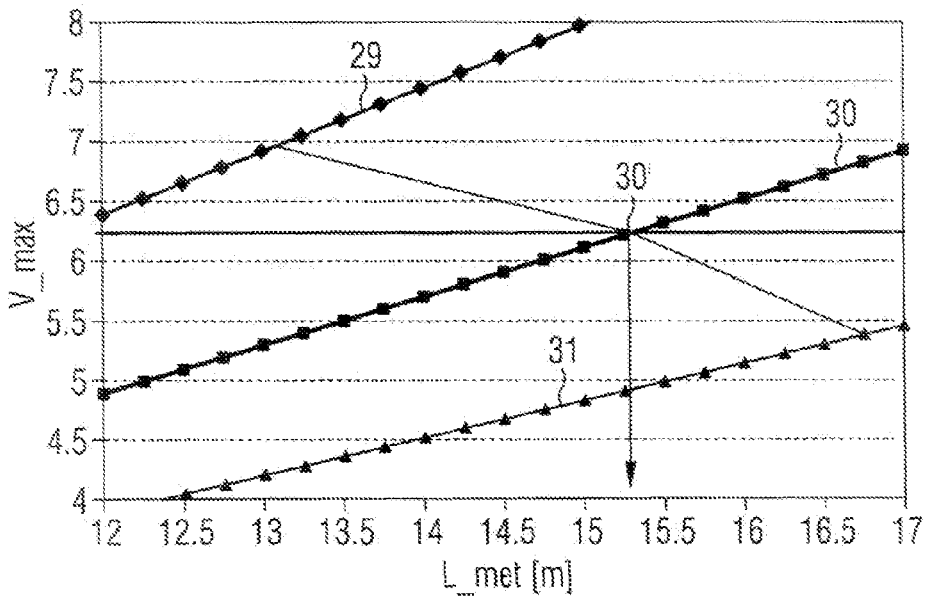
FIG. 6 shows a process diagram of a manufacturing method according to an example embodiment (casting speed as a function of the strand support length)

FIG. 6 shows a diagram in which the maximal casting speed is plotted on the Y-axis and denoted by the unit [m/min], while the strand support length L or the 'metallurgic length' is plotted on the X-axis and denoted by the unit [m]. Three lines 29, 30, 31 are marked, wherein line 29 indicates a strand thickness of 70 mm, line 30 a strand thickness of 80 mm and line 31*a* strand thickness of 90 mm.

A purely exemplary horizontal intersection line drawn in FIG. 6 corresponds to a maximal casting speed of 6.25 m/min. An intersection of this horizontal intersection line and line 30 produces an intersection point 30' which, when projected vertically onto the X-axis, indicates that at casting speeds of 6.25 m/min a strand support length L of approximately 15.3 m would be optimal in order to preserve the molten core tip of the strand close to the end 14 of the strand-guiding device. Conversely, it could be said that maximal casting speeds of 6.25 m/min can be achieved in the case of a strand support length L of 15.3 m.

Further to this, the diagram according to FIG. 6 essentially illustrates the concept that for strands having strand thicknesses of between 60 mm or 70 mm and 90 mm, casting speeds of between 3.8 m/min and 7 m/min are beneficial for the purpose of process optimization in the case of strand support lengths L of between 12 m and 16.5 m.

Figure 7:
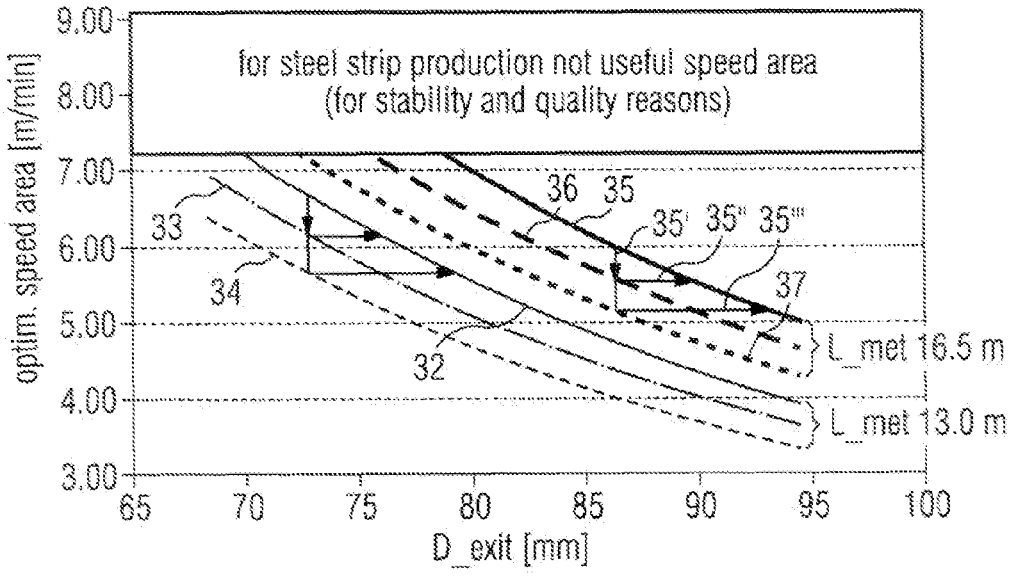
FIG. 7 shows a process diagram of a manufacturing method according to an example embodiment (correlation between target casting speeds and target strand thicknesses).

FIG. 7 illustrates the correlation between the strand thickness d and the casting speed $v_c$, wherein a setting for (target) casting speeds $v_c$ or (target) strand thicknesses d can be determined on the basis of speed factors K that are proposed herein. The correlation of the setting of the strand thickness d in relation to the casting speed $v_c$ is established by a formula $v_c$=[K_lowerLimit . . . K_upperLimit]/$d^2$ which is stored in a device.

The following specifications relate to steady-state continuous operation of the plant, this being understood in the present context to mean operating phases having a time duration of >10 minutes during which the casting speed $v_c$ remains essentially constant (unlike a casting-on phase, for example).

The selection of the speed factor K is dependent in particular on the C content of the cast steels and/or on their cooling characteristics, in addition to the strand support length L.

Rapidly solidifying steel grades allow the plant to be operated at relatively high casting speeds $v_c$, while lower casting speeds $v_c$ should be selected for steel grades that solidify more slowly, in order to prevent bulging and cracking of the strand in the region of the molten core tip. The following tables relate to strands of cast steel grades that are characterized by 'hard' cooling, i.e. solidify rapidly, and 'medium hard' cooling, i.e. solidify rather more slowly.

Corridor ranges within which casting operation can be efficiently and beneficially performed are specified for the speed factor K in each case. A corridor range for a specific strand support length is limited by a speed factor K_upperLimit and a speed factor K_lowerLimit in each case according to the following tables.

The selection of the speed factor K is dependent on the strand support length L and the steel grade, in particular on the carbon content of the cast steels, their solidification or transformation characteristics, their properties in terms of strength and ductility and other material characteristics.

For the purpose of cooling the strand 3, a cooling agent (preferably water) is applied to said strand 3 in the region of the strand-guiding device 6 (between the lower end of the die 2 and that end 14 of the strand-guiding device 6 facing the roughing train 4). The application of the cooling agent to the strand 3 is effected by means of a spray arrangement (not shown) comprising any number of spray nozzles disposed in any desired configuration (e.g. behind and/or beside and/or between the guide elements 9, 10).

3 to 4 liters of cooling agent per kg of strand steel are used for hard cooling, 2 to 3.5 liters of cooling agent per kg of strand steel are used for medium-hard cooling, and <2.2 liters of cooling agent per kg of strand steel are used for soft cooling. The specified cooling agent quantities for hard, medium-hard and soft cooling overlap due to structural features of the spray arrangement and of the strand-guiding device 6 as cited above.

Assuming exemplary and essentially identical structural and boundary conditions for the spray arrangement and the strand-guiding device 6, e.g. 3 to 4 liters of cooling agent per kg strand steel could be used for hard cooling, 2 to 3 liters for medium-hard cooling, and 1 to 2 liters for soft cooling.

TABLE 1

Speed factor K for steel grades having low C content (<0.16%) and relatively hard cooling (3-4 l of cooling agent/kg strand steel):

| | L = 13 m | L = 16.5 m |
|---|---|---|
| K_upperLimit | 35200 | 44650 |
| K_lowerLimit | 30000 | 38000 |

TABLE 2

Speed factor K for steel grades having C content of >0.16% and medium-hard cooling (2-3.5 l of cooling agent/kg strand steel):

| | L = 13 m | L = 16.5 m |
|---|---|---|
| K_upperLimit | 33800 | 42950 |
| K_lowerLimit | 28700 | 36450 |

TABLE 3

Speed factor K for special steel grades and soft cooling (1.0-2.2 cooling agent/kg strand steel):

| | L = 13 m | L = 16.5 m |
|---|---|---|
| K_upperLimit | 32350 | 41200 |
| K_lowerLimit | 26350 | 34850 |

For strand steels that are to be hard cooled, i.e. applying 3 to 4 liters of cooling agent per kg of strand steel, a preferred operating regime (see Table 1) therefore provides for the correlation between a strand thickness d measured in [mm] and the casting speed $v_c$ measured in [m/min] to be governed by the formula $v_c=K/d^2$, wherein the speed factor K lies in a corridor range of 30000 to 35200 (preferably in a corridor range of 32500 to 35200) for a preferably minimal strand support length $L_{min}$ of 13 m, while the speed factor K lies in a corridor range of 38000 to 44650 (preferably in a corridor range of 41000 to 44650) for a preferably maximal strand support length $L_{max}$ of 16.5 m. Interpolation between the corridor ranges listed above (using a further corridor range not listed in the tables) is possible for the purpose of determining (target) casting speeds $v_c$ or (target) strand thicknesses d for plants having strand support lengths L between the preferred strand support lengths $L_{min}$ and $L_{max}$. Interpolation between the corridor ranges takes place in an essentially linear manner.

In the case of strand support lengths of $<L_{min}$, the corridor ranges listed above can also be used for extrapolation.

According to Table 2, for strand steels that are to be medium-hard cooled during steady-state continuous operation of the plant, i.e. applying 2 to 3.5 liters of cooling agent per kg of strand steel, the correlation between a strand thickness d measured in [mm] and the casting speed $v_c$ measured in [m/min] is governed by the formula $v_c=K/d^2$, wherein a speed factor (K) contained in the formula lies in a corridor range of 28700 to 33800 (preferably in a corridor range of 31250 to 33800) for a strand support length L=13 m, while the speed factor K lies in a corridor range of 36450 to 42950 (preferably in a corridor range of 39700 to 42950) for a strand support length L=16.5 m.

According to Table 3, for strand steels that are to be soft cooled during steady-state continuous operation of the plant, i.e. applying 1.0 to 2.2 liters of cooling agent per kg of strand steel, the correlation between a strand thickness d measured in [mm] and the casting speed $v_c$ measured in [m/min] is governed by the formula $v_c=K/d^2$, wherein a speed factor (K) contained in the formula lies in a corridor range of 26350 to 32359 (preferably in a corridor range of 29350 to 32359) for a strand support length L=13 m, while the speed factor K lies in a corridor range of 34850 to 41200 (preferably in a corridor range of 38000 to 41200) for a strand support length L=16.5 m.

FIG. 7 shows a diagram with characteristic curves 32-37 corresponding to the speed factors K listed above. The strand thickness d denoted by the unit [mm] (measured at the end of the strand-guiding device 6 or at the intake into the roughing train 4) is marked on the X-axis of the diagram, while the casting speed denoted by the unit [m/min] is marked on the Y-axis.

The characteristic curves 32, 33 and 34 apply to strand support lengths of L=13 m, while the characteristic curves 35, 36 and 37 apply to strand support lengths of L=16.5 m.

The uppermost characteristic curve applying to a respective specific strand support length L is important for an efficient operating regime in the plant, i.e. the characteristic curve 32 for strand support lengths L=13 m and the characteristic curve 35 for strand support lengths L=16.5 m according to FIG. 7.

The uppermost characteristic curves applying to a specific strand support length L correspond to the speed factors K_upperLimit listed in the tables above. Specifically, characteristic curve 32 corresponds to a speed factor K of 35200 and characteristic curve 35 corresponds to a speed factor K of 44650. The characteristic curves 32 and 35 therefore correspond to rapidly solidifying steel grades which allow high casting speed and heat dissipation while meeting standardized quality criteria.

The lowermost characteristic curves applying to a specific strand support length L according to FIG. 7 (for strand support lengths of L=13 m: characteristic curve 34; for strand support lengths of L=16.5 m: characteristic curve 37) correspond to the speed factors K_lowerLimit listed in the tables.

Due to their slower solidification, the steel grades corresponding to the characteristic curves 36 and 37 are not as 'hard', i.e. cannot be cooled as rapidly as a steel grade corresponding to the characteristic curve 35. Likewise, the steel grades corresponding to the characteristic curves 33 and 34 cannot be cooled as rapidly as a steel grade corresponding to the characteristic curve 32.

The cooling speed largely determines the position of the molten core tip within the strand 3. Casting speeds above the characteristic curves 32-37 for specific steel grades should be avoided, in order to avoid bulging and cracking of the strand 3 in the region of the molten core tip. In other words, the characteristic curves 32-37 represent limit casting speed curves for different steel types.

In the case of an operating regime identical to that shown in FIG. 7 by the starting point of an arrow 35', having a casting speed of $v_c$=6 m/min and a strand thickness of d=86 mm, e.g. the molten core tip of the strand 3 would be located at the end of the strand-guiding device 6, i.e. as closely as possible to the entrance to the roughing train 4, thereby ensuring optimal utilization of the casting heat for the subsequent rolling process. If the casting speed $v_c$ is now reduced to 5.5 m/min for operational reasons as shown by arrow 35' for example, the strand thickness d would have to be increased to approximately 90 mm as per arrow 35" in order to ensure that the molten core tip of the strand 3 is preserved at the end of the strand-guiding device 6 and to ensure optimal utilization of the casting heat for the subsequent rolling process. Similarly, in the case of a reduction of the casting speed $v_c$ to 5.2 m/min as per arrow 35'", an increase in the strand thickness d to approximately 93 mm is indicated in order to preserve the molten sore tip of the strand 3 at the end of the strand-guiding device 6.

Conversely, an increase in the casting speed $v_c$ (e.g. after resolving operational problems which required a temporary reduction in the casting speed $v_c$) must be accompanied by a corresponding reduction in the strand thickness d, in order to prevent the risk of the strand 3 bulging in the region of the molten core tip.

Possible operational reasons requiring a reduction in the casting speed $v_c$ include, for example, irregularities detected by sensors in the region of the slide or the die, in particular at the bath level of the die, or deviations of the strand temperature from predetermined values.

A change in the strand thickness d can be effected by means of the LCR guide segment 16' using dynamic LCR thickness reduction as described above.

If the casting speed $v_c$ drops such that it no longer lies within the correlations listed in the foregoing, the operating team is notified by means of an output device, such that the liquid core reduction (LCR) can be decreased in order thereby to increase the strand thickness d, thus reestablishing the inventive correlation and/or returning to a relevant corridor range. An upper region of the corridor may be preferred in this case.

Depending on which parameter is considered by the operators to be the main parameter of the plant (the strand thickness d or the casting speed $v_c$), a corresponding target-casting speed $v_c$ can be selected on the basis of a desired strand thickness d or the strand thickness d can be varied on the basis of a desired casting speed $v_c$ accordingly.

It should be noted that for the sake of high operational stability the above described changes to the strand thickness d are only performed in response to relevant changes to the casting speed $v_c$ (e.g. in response to changes to $v_c$ of approximately 0.25 m/min), and not in response to any slight deviation of the casting speed $v_c$ from a currently preferred target-casting speed.

In accordance with the inventive characteristic curves or the corresponding speed factors K, the strand thickness d can be increased if the casting speed $v_c$ decreases, thereby increasing and hence optimizing the material throughput.

Since casting speeds $v_c$ higher than approximately 7 m/min are barely achievable for stable casting, this region has been excluded from the diagram according to FIG. 7.

What is claimed is:

1. A method for the continuous or semicontinuous production of hot steel strip, comprising:

casting a strand by guiding the strand through a strand-guiding device, feeding the strand directly to a roughing train, rolling the strand in the roughing train to form an intermediate strip, and further rolling the strand in a finishing train to form a finished strip, wherein the strand-guiding device performs a liquid core reduction (LCR) process to reduce thickness of the strand from an initial thickness in the range 95to 110mm, while the strand has a liquid cross-sectional core, to a strand thickness of between 60 mm and 95 mm, wherein a strand support length measured between a meniscus and an end of the strand-guiding device facing the roughing train is between 12 m and 15.5 m, and wherein a casting speed lies in a range of 3.8-7 m/min, wherein rough-rolling of the strand in the roughing train to form an intermediate strip takes place in at least four reduction stages using at least four roughing stands, wherein the reduction which takes place in the roughing train takes place within at most 80 seconds; and heating the intermediate strip which emerges from the roughing train by an inductive heating arrangement using a cross-field heating method starting from a temperature above 725° C. and ending at a temperature of at least 1100° C.

2. The method of claim 1, wherein a first reduction stage of the at least four reduction stages in the roughing train takes place within at most 5.7 minutes from a start of solidification of a liquid strand in a die that feeds the strand-guiding device.

3. The method of claim 1, wherein only cooling of the strand that is caused by ambient temperature is permitted between the end of the strand-guiding device and an intake region of the roughing train.

4. The method of claim 1, wherein the thickness of the strand is reduced by 35-60% per reduction stage in the roughing train.

5. The method of claim 1, wherein a temperature loss rate of the intermediate strip emerging from the roughing train is less than a maximum of 3 K/m.

6. The method of claim 1, wherein the heating of the intermediate strip takes place within a time span of 4 to 30 seconds.

7. The method of claim 1, wherein exactly four reduction stages are performed in the roughing train, the time duration between a first reduction stage and intake into the heating arrangement is no longer than 110 seconds for an intermediate strip thickness of 5-10 mm.

8. The method of claim 1, further comprising finish-rolling of the heated intermediate strip in the finishing train in four or five reduction stages using four or five finishing stands to form a finished strip of less than 1.5 mm thickness.

9. The method of claim 8, wherein the reduction stages performed within the finishing train take place within a maximal time span of 12 seconds.

10. The method of claim 1, wherein guide elements of the strand-guiding device, which are designed to provide contact with the strand, can be adjusted relative to a longitudinal axis of the strand for the purpose of LCR thickness reduction of the strand, wherein adjustment of the guide elements is performed as a function of at least one of the material of the strand and the casting speed.

11. The method of claim 10, wherein the strand thickness can be set in a quasi static manner after the start of a casting sequence.

12. The method of claim 10, wherein the strand thickness can be varied during the casting process or during the passage of the strand through the strand-guiding device.

13. The method of claim 1, wherein for particular strand steels cooled by spray arrangement applying 3 to 4 liters of cooling agent per kg of strand steel, the correlation between the strand thickness measured in [mm] and the casting speed measured in [m/min] is governed by the formula $v_c=K/d^2$, wherein $v_c$ is the casting speed, d is the strand thickness, and K is a speed factor, wherein the speed factor lies in a range of 30000 to 35200when strand support length is set to 13 m, while the speed factor lies in a range of 38000to 44650 when strand support length is set to 16.5 m, and determining casting speeds or strand thicknesses for strand support lengths between 13 m and 16.5 m by interpolating between the ranges.

14. The method of claim 1, wherein for particular strand steels cooled by a spray arrangement applying 2 to 3.5 liters of cooling agent per kg of strand steel, the correlation between a strand thickness measured in [mm] and the casting speed measured in [m/min] is governed by the formula $v_c=Kd^2$, wherein $v_c$ is the casting speed, d is the strand thickness, and K is a speed factor, wherein the speed factor lies in a range of 28700 to 33800when strand support length is set to 13 m, while the speed factor lies in a range of 36450to 42950 when strand support length is set to 16.5 m, and determining casting speeds or strand thicknesses for strand support lengths between 13 m and 16.5 m by interpolating between ranges.

15. The method of claim 1, wherein for particular strand steels cooled by a spray arrangement applying less than 2.2 liters of cooling agent per kg of strand steel, the correlation between a strand thickness measured in [mm] and the casting speed measured in [m/min] is governed by the formula $v_c=K/d^2$, wherein $v_c$ is the casting speed, d is the strand thickness, and K is a speed factor, wherein the speed factor lies in a range of 26350 to 32359 when strand support length is set to 13 m, while the speed factor lies in a range of 34850 to 41200 when strand support length is set to 16.5 m, and determining casting speeds or strand thicknesses for strand support lengths between 13 m and 16.5 m by interpolating between the ranges.

16. A plant for performing a method for continuous or semicontinuous production of hot steel strip, comprising:

a die, a strand-guiding device arranged downstream of the die, a roughing train arranged downstream of and directly after the strand-guiding device, an inductive heating arrangement arranged downstream of the roughing train, and a finishing train arranged downstream of the inductive heating arrangement, and a control device, wherein said strand-guiding device includes a series of lower guide elements and a series of upper guide elements that is arranged in parallel or converges therewith, and wherein a receiving slot for receiving the strand that emerges from the die is formed between the two series of guide elements, said receiving slot being tapered at least sectionally by forming different distances between opposing guide elements in a transport direction of the strand such that the thickness of the strand can be reduced, wherein the internal receiving width of the receiving slot at its entrance region facing the die is between 95 mm and 110 mm, wherein the receiving slot at its end facing the roughing train has an internal receiving width corresponding to the thickness of the strand of between 60 mm and 95 mm, wherein a strand support length measured between a meniscus and the end of the receiving slot of the strand-guiding device facing the roughing train is between 12 m and 15.5 m, and for the control device that controls the casting speed of the strand and maintains the casting speed of the strand in a range of between 3.8-7 m/min, wherein the roughing train comprises four or five roughing stands, and wherein the heating arrangement is designed as an inductive cross-field heating furnace by means of which the strand can be heated, starting from a temperature above 725° C., to a temperature of at least 1100° C., and wherein no cooling device but a thermal cover is provided between the end of the receiving slot or strand-guiding device and an intake region of the roughing train.

17. The plant of claim 16, wherein by means of the roughing stands arranged in the roughing train, it is possible in each case to achieve a reduction in the thickness of the strand of 35-60% per roughing stand, thereby allowing the production of an intermediate strip having a thickness of between 3 mm and 15 mm.

18. The plant of claim 16, wherein the finishing train comprises four finishing stands or five finishing stands, by means of which an intermediate strip emerging from the roughing train can be reduced to form a finished strip having a thickness of less than 1.5 mm.

19. The plant of claim 18, wherein the finishing stands are disposed at distances of less than 7 m relative to each other in each case, said distances being measured between working roll axes of the finishing stands.

20. The plant of claim 16, wherein for the purpose of reducing the thickness of the strand, specific guide elements are adjustable such that an internal receiving width of the receiving slot can be decreased or increased, wherein the strand thickness or the internal receiving width can be set as a function of the material of the strand and/or the casting speed.

21. The plant of claim 20, wherein the adjustable guide elements are disposed in a front half, facing the die, of the longitudinal extension of the strand-guiding device.

22. The plant of claim 16, wherein a working roll axis of a first roughing stand in the roughing train, being closest to the strand-guiding device, is disposed no more than 7 m beyond the end of the strand-guiding device.

23. The plant of claim 16, wherein an intake end of the heating arrangement facing the roughing train is disposed no more than 25 m beyond a working roll axis of the roughing stand closest to the heating arrangement.

* * * * *